US006706957B1

(12) United States Patent
Merkel

(10) Patent No.: US 6,706,957 B1
(45) Date of Patent: Mar. 16, 2004

(54) INTONATION SYSTEM FOR FRETTED INSTRUMENTS

(76) Inventor: Steven L. Merkel, 7245 Smithfield Rd., Mobile, AL (US) 36695

( * ) Notice: Subject to any disclaimer, the term of this patent is extended or adjusted under 35 U.S.C. 154(b) by 0 days.

(21) Appl. No.: 10/376,703

(22) Filed: Mar. 3, 2003

(51) Int. Cl.[7] ..... G10D 3/06
(52) U.S. Cl. ..... 84/314 N; 84/314 R
(58) Field of Search ..... 84/314 N, 312 R, 84/314 R

(56) References Cited

U.S. PATENT DOCUMENTS

| | | | | |
|---|---|---|---|---|
| 4,248,126 A | | 2/1981 | Lieber | |
| 4,696,219 A | * | 9/1987 | Plescia | 84/314 N |
| 4,951,543 A | | 8/1990 | Cipriani | |
| 5,052,260 A | | 10/1991 | Cipriani | |
| 5,208,410 A | | 5/1993 | Foley | |
| 5,347,905 A | | 9/1994 | Cipriani | |
| 5,481,956 A | | 1/1996 | LoJacono et al. | |
| 5,600,078 A | | 2/1997 | Edwards | |
| 5,644,094 A | | 7/1997 | Dickson, II | |
| 5,750,910 A | | 5/1998 | LoJacono | |
| 5,952,593 A | * | 9/1999 | Wilder | 84/314 R |
| 5,969,279 A | | 10/1999 | Dickson, II | |
| 6,156,962 A | | 12/2000 | Poort | |
| 6,359,202 B1 | | 3/2002 | Feiten et al. | |

OTHER PUBLICATIONS

From a Web Site "www.earvana.com" Maintained by Earvana, LLC, P.O. Box 4297, Paso Robles, CA 93447.

* cited by examiner

*Primary Examiner*—Kimberly Lockett
(74) *Attorney, Agent, or Firm*—George L. Williamson

(57) ABSTRACT

The present invention discloses a custom compensated nut and a custom compensated saddle for fretted instruments. Several embodiments are provided for the compensated nut and for the compensated saddle of the present invention. The nut and saddle of the present invention may be used on an instrument either individually or in tandem.

20 Claims, 10 Drawing Sheets

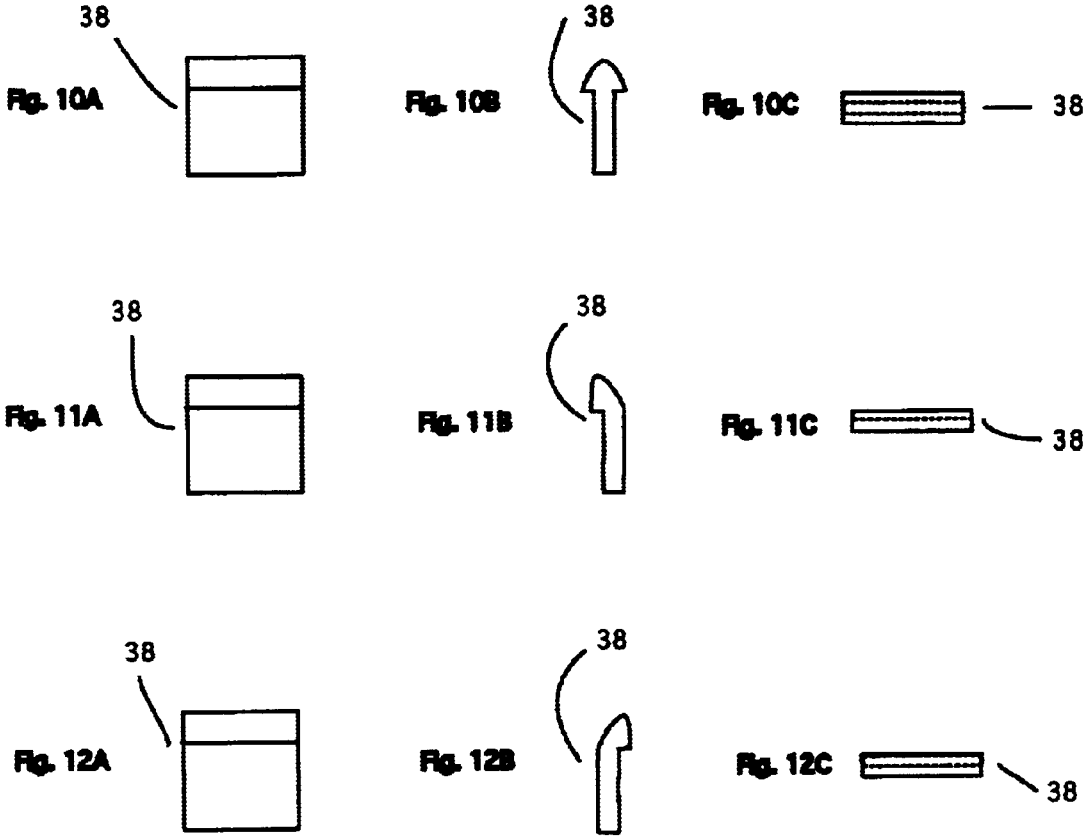
38
Fig. 10A
38
Fig. 10B
Fig. 10C
38
38
Fig. 11A
38
Fig. 11B
Fig. 11C
38
38
Fig. 12A
38
Fig. 12B
Fig. 12C
38
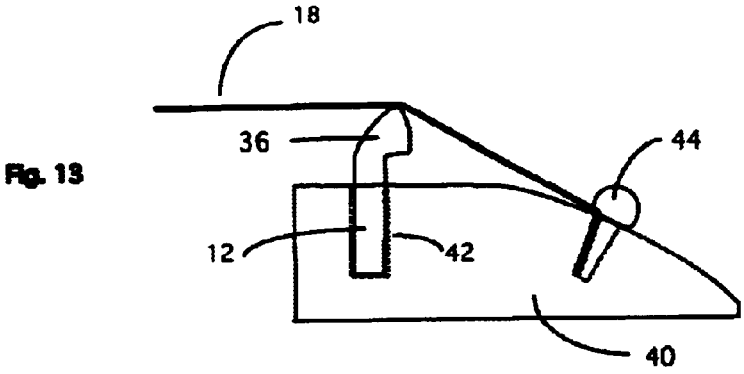
18
36
44
Fig. 13
12
42
40

INTONATION SYSTEM FOR FRETTED INSTRUMENTS

BACKGROUND OF THE INVENTION

1. Field of the Invention

The present invention relates generally to intonation systems for fretted instruments and, more particularly, is concerned with a custom compensated nut and a custom compensated saddle or bridge for fretted instruments.

2. Description of the Prior Art

Intonation systems have been described in the prior art. However, none of the prior art devices disclose the unique features of the present.

In U.S. Pat. No. 6,156,962 dated Dec. 5, 2000, Poort disclosed a stringed instrument having a body and a neck with a fingerboard extending from the body. The body has a bridge for supporting first end portions of a plurality of strings arranged in a series of decreasing thickness, and a nut at an end of the fingerboard is placed so as to provide support for a second end portion of the plurality of strings. The fingerboard has a plurality of frets located between the bridge and the nut, where the first fret is defined as the fret closest to the nut. The distance between the nut and the first fret for each of the plurality of strings is inversely proportional to the thickness of the corresponding string so that a thin, high pitched string has a greater distance between the nut and the first fret than does a thicker, lower pitched string.

In U.S. Pat. No. 5,481,956, dated Jan. 9, 1996, LoJacono, et al., described an apparatus and method of tuning a string instrument such as electric guitars which is commonly provided with a solid body structure and a fretboard, wherein the tuning apparatus includes an adjustable bridge in which there is provided a plurality of adjustable saddle bridge members secured to the body of the guitar, and a nut having a plurality of adjustable nut saddle members mounted at the distal end of the fretboard adjacent the tension mechanism to which the strings are attached. The adjustment of the bridge saddle members establishes a true intonation of each string with respect to the twelfth fret and all of the intervals between the twelfth fret and the bridge. The nut saddle members are adjusted to establish a true intonation of each string with respect to the first fret and the intervening intervals between the first fret and the twelfth fret. The adjustment of both the bridge and the nut determines the length of each string and the longitudinal position of each string over the twelfth and first fret, whereby each string throughout its length is arranges so as to have a substantially "zero" cent condition.

In U.S. Pat. No. 5,969,279, dated Oct. 19, 1999, Dickson, II disclosed an improved saddle for stringed musical instruments comprised of a single unitary member configured in a somewhat comblike structure, the backbone portion of which is curved and forms a string-engaging and supporting surface. The teeth-forming portions form a plurality of sound-coupling and supporting pedestals, each of which lie directly beneath a string and terminate in a distal end that is adapted to bear against a bridge plate the soundboard of the instrument.

In U.S. Pat. No. 5,644,094, dated Jul. 1, 1997, Dickson, II disclosed an improved bridge for stringed musical instruments having a single unitary member configured in a somewhat comblike structure, the backbone portion of which forms a string-engaging and supporting surface. The teeth-forming portions form a plurality of sound-coupling and supporting pedestals, each of which lie directly beneath a string and terminate in a distal end which is flared to form an enlarged base that is adapted to bear against the soundboard of the instrument.

In U.S. Pat. No. 5,750,910, dated May 12, 1998, LoJacono disclosed an apparatus and method of tuning a string instrument such as an electric guitar which is commonly provided with a solid body structure and a fretboard, wherein the tuning apparatus includes an adjustable bridge provided with a plurality of adjustable saddle bridge members secured to the body of the guitar, and a nut having a plurality of adjustable nut saddle members mounted at the distal end of the fretboard adjacent the tension mechanism to which the strings are attached. The adjustment of the bridge saddle members establishes a true intonation of each string with respect to the twelfth fret and all of the intervals between the twelfth fret and the bridge. The nut saddle members are adjusted to establish a true intonation of each string with respect to the first fret and the intervening intervals between the first fret and the twelfth fret. The adjustment of both the bridge and the nut determines the length of each string and the longitudinal position of each string over the first and twelfth fret, whereby each string throughout its length is arranged so as to have a substantially "zero" cent condition.

In U .S. Pat. No. 5,052,260, dated Oct. 1, 1991, Cipriani disclosed a bridge assembly for a stringed musical instrument having a block-like platform member secured to a bridge member which is fixed with respect to a sound board cover of the instrument the bridge member has an upper surface with a groove therein seating of the platform member. The platform member has a lower portion fixedly inserted in the groove and an integral upper portion extending out of the groove and above said upper surface of the bridge member. A string of the instrument passes on a saddle under tension, the contact of the string with the saddle establishing the vibration length of the string. The saddle is connected to the platform member for longitudinal adjustment thereon to effect string length fine tuning. The saddle is movable between end positions at which the saddle remains positioned above the lower portion of the platform member so that vertical force applied to the saddle by the string will always be transmitted to the lower portion of the platform member therebelow and then to the bridge member and the sound board cover.

In U.S. Pat. No. 5,347,905, dated Sep. 20, 1994, Cipriani disclosed a bridge assembly for a guitar mounted on a soundboard over of a resonating box, the bridge assembly comprising a bridge fixed on the soundboard cover, a block-like platform secured to the bridge and transversely spaced saddles on which the guitar strings pass under tension. The strings contact the saddles at points of support and establish vibration lengths of the strings. The strings undergo change of angle at their points of support to apply force along a line of action passing through the platform to the soundboard cover and the resonating box. The saddles are connected to the platform for adjustment longitudinally of the strings to vary the vibration length of the strings and thereby affect string length fine tuning. At the end positions of adjustment of the saddles, and for all positions therebetween, forces applied by the strings will be directed to pass to the soundboard cover either directly through the platform or through a thin portion of the bridge on which the platform rests. The force acts in a direction substantially perpendicular to the upper surface of the thin portion of the bridge. A transducer can be interposed between each saddle and the platform and resiliently clamped therebetween.

In U.S. Pat. No. 4,951,543, dated Aug. 28, 1990, Cipriani disclosed a bridge for improving volume, power and sustaining quality in a stringed musical instrument of the type having a hollow body over which are stretched substantially parallel strings, each string being stretched. The string height is raised over the sound board. One end of the string may be anchored to a crossbrace on the underside of the sound board so as to directly vibrate this sound board. It also incorporates a means for string length fine tuning. The result is increased sound, volume and resonance persistence which is without distortion that may result in increased amplification when applied to guitars or other stringed instruments.

In U.S. Pat. No. 6,359,202 B1, dated Mar. 19, 2002, Feiten, et al., disclosed a method and apparatus for fully adjusting and providing tempered intonation for stringed fretted musical instruments and making adjustments to the Rule of 18.

In U.S. Pat. No. 5,600,078, dated Feb. 4, 1997, Edwards disclosed a bridge for a string instrument having, a body and at least one string. A base is provided for mounting the bridge on the body of the instrument. An intonation adjustment member is slidably mounted on the base for adjusting the horizontal position at which a string is supported by the bridge. A height adjustment member is slidably mounted on the intonation adjustment member for adjusting the vertical position of the string above the body. The intonation adjustment member has a ramp portion for slidably supporting the height adjustment member while maintaining substantially constant contact surface area. Horizontal position of the intonation adjustment member and vertical position of the height adjustment member are adjusted by respective elongate threaded shafts. The intonation adjustment member interlocks with the base, and the height adjustment, member interlocks with the intonation adjustment member.

In U.S. Pat. No. 5,208,410, dated May 4, 1993, Foley disclosed an improved acoustic guitar bridge having string intonation, height, and tilt adjustment and comprising an anchor joined to and protruding downwardly from a chassis housing a plurality of forwardly and rearwardly adjustable saddles. Stabilizer legs for height adjustment and chassis tilt control extend down from the chassis.

In U.S. Pat. No. 4,248,126, dated Feb. 3, 1981, Lieber disclosed a panel having a rear wall which is movably secured to the lower portion of a guitar body by a pair of screws allowing it to be moved toward and away from the guitar body. A sliding member is disposed in the panel under each guitar string, with a string contacting member secured on top of each slidable member and itself being slidable laterally thereon. Accordingly, guitar strings can be adjusted up and down the guitar, toward and away from the body, and across the fretboard, to thereby achieve optimum intonation and playability.

A company named Earvana, LLC, which has an address of P.O. Box 4297, Paso Robles, Calif. 93447 and internet web site address of "www.earvana.com" has disclosed on its web site a compensated nut which the company claims has the ability to change the string break-off location with mathematical precision in order to improve the overall playability of the guitar. Further, the company claims improvement of the intonation throughout the fretboard when playing chords and notes.

While these intonation systems may be suitable for the purposes for which they were designed, they would not be as suitable for the purposes of the present invention, as hereinafter described.

SUMMARY OF THE PRESENT INVENTION

The present invention discloses a custom compensated nut and a custom compensated saddle for fretted instruments. Several embodiments are provided for the compensated nut and for the compensated saddle of the present invention. The nut and saddle of the present invention may be used on an instrument either individually or in tandem.

An object of the present invention is to provide improved means for correcting intonation problems with fretted instruments. A further object of the present invention is to provide a custom-made compensated nut or saddle for the fretted instrument. A further object of the present invention is to provide an intonation system for fretted instruments that can be easily and simply manufactured without irreversible modification to the instrument.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 10A is a front view of one embodiment of the present invention.

FIG. 10B is a side view of one embodiment of the present invention.

FIG. 10C is a top view of one embodiment of the present invention.

FIG. 11A is a front view of one embodiment of the present invention.

FIG. 11B is a side view of one embodiment of the present invention.

FIG. 11C is a top view of one embodiment of the present invention.

FIG. 12A is a front view of one embodiment of the present invention.

FIG. 12B is a side view of one embodiment of the present invention.

FIG. 12C is a top view of one embodiment of the present invention.

FIG. 13 is an elevation view of the bridge showing one embodiment of the present invention in operative connection therewith.

LIST OF REFERENCE NUMERALS

Figure 1A:
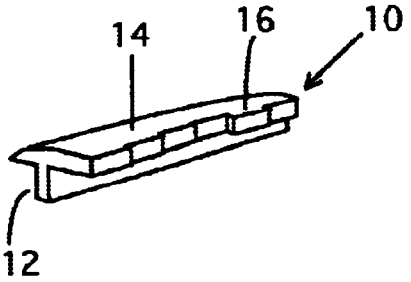
FIG. 1A is an isometric view of an embodiment of the present invention.
Figure 1B:
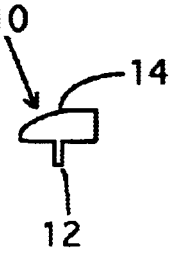
FIG. 1B is a side view of one embodiment of the present invention.
Figure 1C:
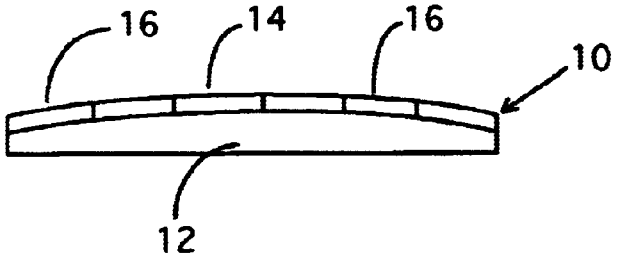
FIG. 1C is a front view of one embodiment of the present invention.
Figure 1D:
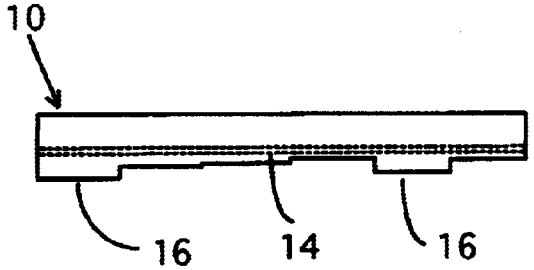
FIG. 1D is a top view of one embodiment of the present invention.
Figure 1E:
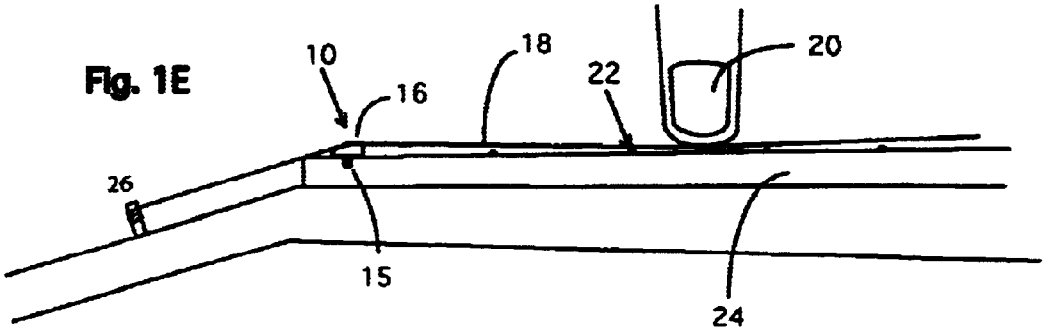
FIG. 1E is an elevation view of the neck of a fretted musical instrument.
Figure 2A:
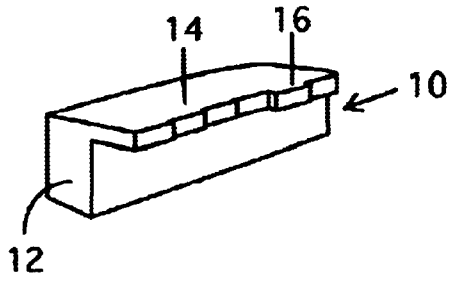
FIG. 2A is an isometric view of an embodiment of the present invention.
Figure 2B:
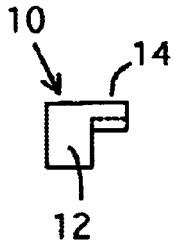
FIG. 2B is a side view of one embodiment of the present invention.
Figure 2C:
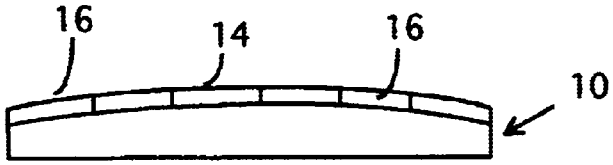
FIG. 2C is a front view of one embodiment of the present invention.
Figure 2D:
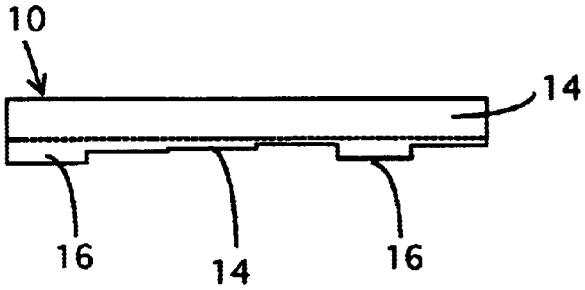
FIG. 2D is a top view of one embodiment of the present invention.
Figure 2E:
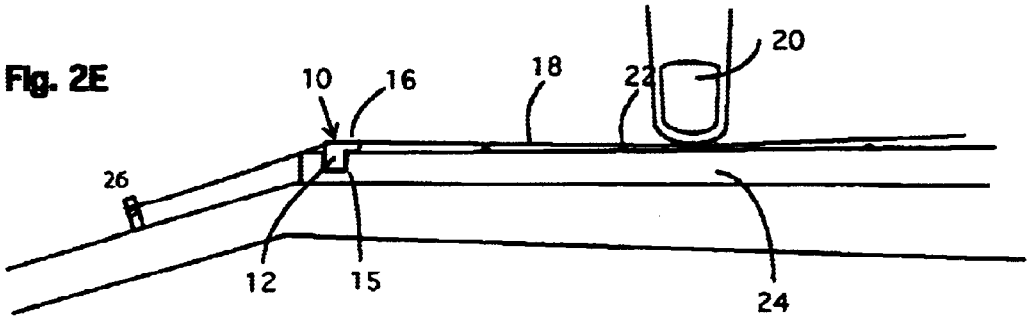
FIG. 2E is an elevation view of the neck of a fretted musical instrument.
Figure 3A:
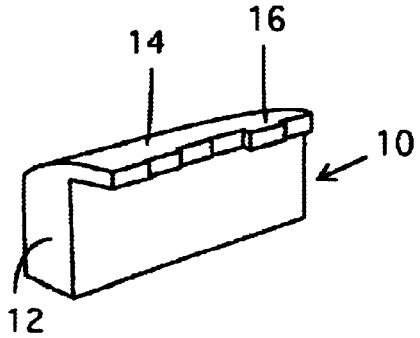
FIG. 3A is an isometric view of an embodiment of the present invention.
Figure 3B:
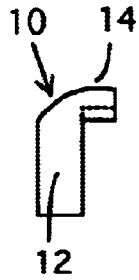
FIG. 3B is a side view of one embodiment of the present invention.
Figure 3C:
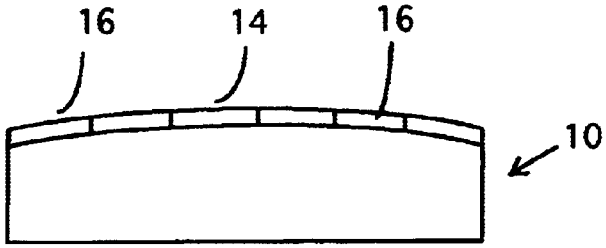
FIG. 3C is a front view of one embodiment of the present invention.
Figure 3D:
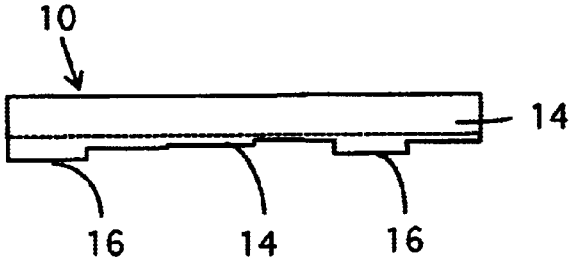
FIG. 3D is a top view of one embodiment of the present invention.
Figure 3E:
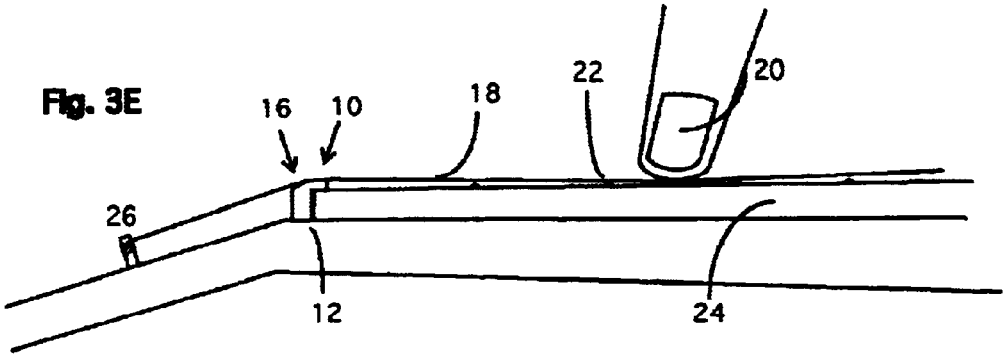
FIG. 3E is an elevation view of the neck of a fretted musical instrument.

With regard to reference numerals used, the following numbering is used throughout the drawings.

10 nut
12 pedestal base
14 crown
15 slot
16 vibration point
18 string
20 finger
22 fret
24 fingerboard/fretboard
26 tuning keys
28 existing nut
30 shim
32 individual piece
34 blank
36 saddle
38 individual saddle element
40 bridge
bridge slot/groove
bridge pin
saddle blank

DETAILED DESCRIPTION OF THE PREFERRED EMBODIMENT

The following discussion describes in detail one embodiment of the present invention along with several other embodiments. This discussion should not be construed, however, as limiting the invention to those particular embodiments since practitioners skilled in the art will recognize numerous other embodiments as well. For a definition of the complete scope of the invention the reader is directed to the appended claims. FIGS. 1A through 14D illustrate the present invention wherein an intonation system for fretted instruments is disclosed.

This intonation system consists of a process and specific components designed to improve the intonation of all fretted musical instruments.

Specifically, the system has two main components: a custom compensated nut; and a custom compensated saddle (bridge piece). While compensated nuts and saddles are not a completely new idea, the present invention approaches the design and implementation of these components in a unique way.

The present invention provides individual string compensation at both the nut and the saddle (bridge) without the need for modification to the instrument (other than the replacement of the nut and saddle). Any modification is completely reversible by re-installing the original components. This is one of the most significant advantages of the invention.

By way of general explanation, each individual string responds differently to the forces exerted on them during the act of playing or "fretting" the string. As the string is depressed, the tension on the string increases, thereby raising the frequency or pitch of the string. The precise location of each fret is mathematically derived; however, most guitar manufacturers do not factor in the "additive" raised pitch that occurs during the act of "fretting" the string. Also as a guitar ages, fret wear flattens the crown of the fret which changes the specific mathematical center, or vibration point, of the fret, thereby shortening the string length further. The purpose of the compensated nut is to adjust the pitch of the open string (vibrating at the nut or "non-fretted" position). Most typically, this adjustment will be to move the vibration point of the nut forward (toward the $1^{st}$ fret). Careful measurement will determine the amount of compensation needed to bring the pitch of the open string into alignment with the nominal pitch of the notes generated on or around the $3^{rd}$ fret. While the process is not limited to the exact specifics outlined here, this would entail tuning the pitch of the string to the correct frequency of the designated note relative to the fret, for instance, the note G on the $3^{rd}$ fret of the E string (or $1^{st}$ string on a guitar). While fret placement is mathematical, the actual note generated is somewhat different and is affected by the player's style of playing and the set up (or height of strings relative to the fingerboard). Once the correct "real world" note pitch produced by actually fretting (depressing the string) is established, the note pitch of the open string (pitch of string vibrating at the nut . . . or unfretted note) is measured. The relative pitch differential that usually occurs becomes the basis of the amount of compensation indicated. For instance, if the note G is tuned to pitch (played at the $3^{rd}$ fret) and the open note is then sounded and measured, the measured pitch of the open note is often between 2 and 5 cents flat to the relative pitch of the open string (the note E in this case). A cent is $1/100^{th}$ of a semi-tone. This pitch differential expressed in cents is multiplied times the distance between the nut and the $1^{st}$ fret. For instance, −0.05 times 1.7 inches . . . which equals −0.085 inches. This will be the distance the vibration point of the nut needs to be moved forward (or closer to the first fret). The vibration point of the saddle can be compensated in a similar fashion. Once a true and accurate note pitch is established at the open string, a note pitch measurement is taken at the $12^{th}$ fret (on a guitar) at the octave point. Any measured pitch differential will be compensated at the saddle by utilizing a similar process. For instance, if the measured pitch at the $12^{th}$ fret is 5 cents sharp, the vibration point at the saddle needs to be moved back 05/100 of the distance between the $12^{th}$ and $13^{th}$ fret (one semi-tone) which effectively lengthens the string and lowers the pitch. Guitars and other fretted instruments often exhibit anomalies that will require that a similar relationship needs to be measured and accounted for at the octave points of other notes. For instance, one might play a low G on the $3^{rd}$ fret and measure the pitch at the octave point (or $15^{th}$ fret). Patterns will become apparent that will dictate the amount of shortening or lengthening necessary to produce proper intonation of the fretted instrument.

The present invention is substantially different in that it compensates each string individually and allows compensation beyond the limits or boundaries that are imposed by the width of the saddle slot (which is routed or cut into a wooden bridge in most situations). The ability of the present invention to offer compensation beyond traditional methods is clearly visible in the drawings.

In this patent application, use of the term "fretted instruments" includes, but is not limited to: electric guitars, acoustic guitars, electric basses, banjos, mandolins, bazoukis, mandolas, dulcimers, and lutes.

Turning to FIGS. 1A–1E, shown therein is one embodiment of the present invention being a compensated nut 10. This is a single piece embodiment of a compensated nut 10 of the present invention and may be referred to as the zero fret nut. Shown therein are the nut 10, the pedestal base 12, which pedestal base is normally inserted into a fret slot 15 in the fingerboard of a fretted instrument in the conventional manner. Also shown is the crown 14 of the nut 10 showing a configuration of the vibration points 16 which vibration points will extend over the fingerboard 24 of the fretted instrument to compensate for the string 18 stretch. Also shown are frets 22 being depressed by a finger 20 of a player or user of the musical instrument having the present invention 10 mounted thereon. Note that the vibration points 16 are of various sizes or lengths, i.e., they extend down the fingerboard 24 various distances as necessary for proper compensation of the intonation in order to obtain the true pitch. The crown 14 refers to the entire upper curved portion of the nut (or saddle) and the vibration point 16 refers to the point of contact, or vibration point, on the crown 14 (or saddle) where the string 18 rests on the crown 14 (or saddle). This embodiment, along with other embodiments, can be described according to its location with respect to, for example, the end of fingerboard 24, or its orientation with respect to the fingerboard, i.e., being perpendicular thereto, the location of the pedestal base with respect to the faces of the crown, the width of the pedestal base with respect to the width of the crown, or the location of the vibration points with respect to the crown or width of the slot within which the pedestal is disposed.

Turning to FIGS. 2A–2E, shown therein is one embodiment of the present invention. Therein is shown the single piece embodiment of the compensated nut 10 of the present invention which may be for use with an electric guitar or an inset nut. Shown therein are the nut 10, the pedestal base 12, which pedestal base is normally inserted into a slot or groove 15 in the fingerboard of a fretted instrument in the conventional manner. Also shown is the crown 14 of the nut 10 showing a configuration of the vibration points 16 which vibration points will extend over the fingerboard 24 of the fretted instrument to compensate for the string 18 stretch. Also shown are frets 22 being depressed by a finger 20 of a player or user of the musical instrument having the present invention mounted thereon. Note that the vibration points 16 are of various lengths.

Turning to FIGS. 3A–3E, shown therein is one embodiment of the present invention being a single piece embodiment of the compensated nut 10 of the present invention. Shown therein are the nut 10, the pedestal base 12, which pedestal base is normally disposed at the end of the fingerboard 24 of a fretted instrument in the conventional manner. Also shown is the crown 14 of the nut 10 showing a configuration of the vibration points 16 which vibration points will extend over the fingerboard 24 of the fretted instrument to compensate for the string 18 stretch. Also shown are frets 22 being depressed by a finger 20 of a player or user of the musical instrument having the present invention mounted thereon. Note that the vibration points 16 are of various sizes or lengths.

Figure 4A:
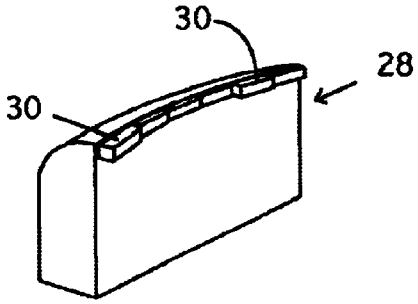
FIG. 4A is an isometric view of an embodiment of the present invention.
Figure 4B:
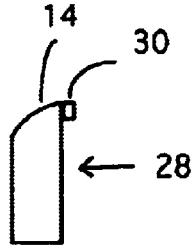
FIG. 4B is a side view of one embodiment of the present invention.
Figure 4C:
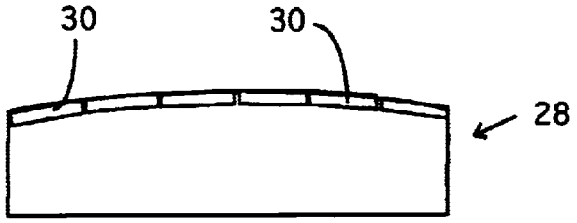
FIG. 4C is a front view of one embodiment of the present invention.
Figure 4D:
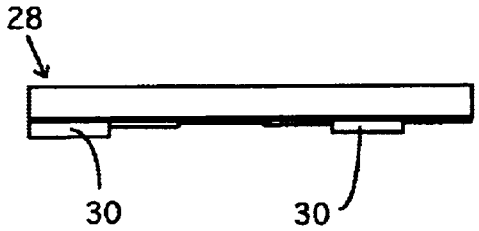
FIG. 4D is a top view of one embodiment of the present invention.
Figure 4E:
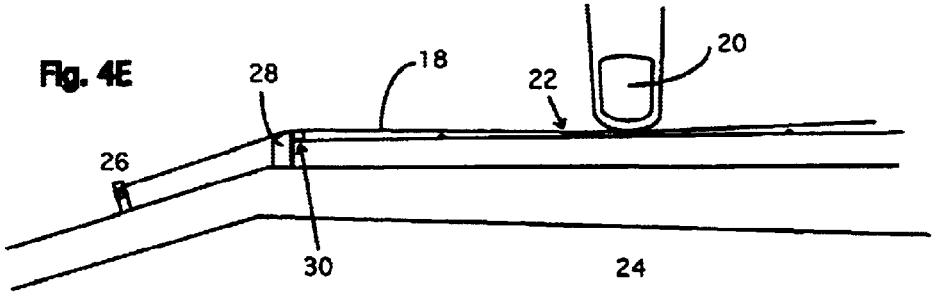
FIG. 4E is an elevation view of the neck of a fretted musical instrument.
Figure 5A:
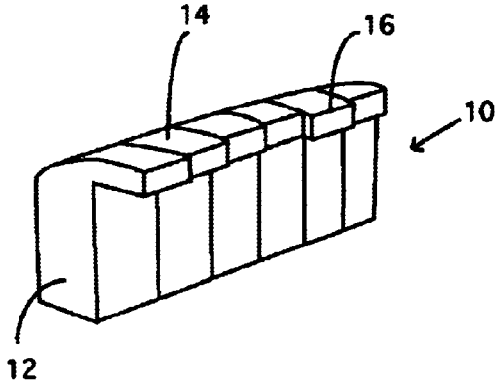
FIG. 5A is an isometric view of an embodiment of the present invention.
Figure 5B:
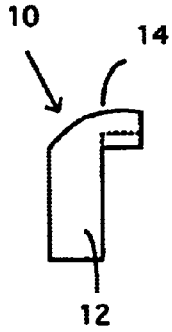
FIG. 5B is a side view of one embodiment of the present invention.
Figure 5C:
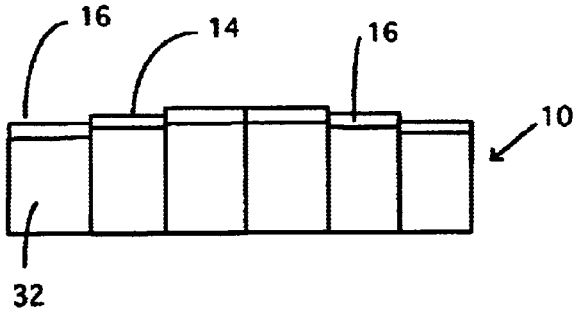
FIG. 5C is a front view of one embodiment of the present invention.
Figure 5D:
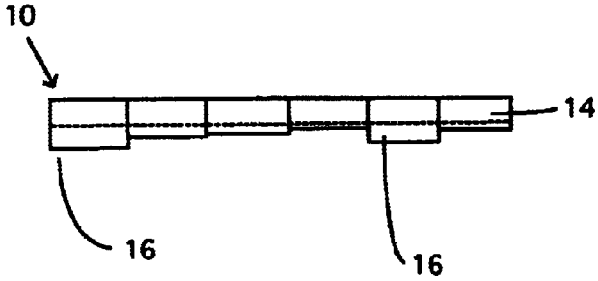
FIG. 5D is a top view of one embodiment of the present invention.
Figure 5E:
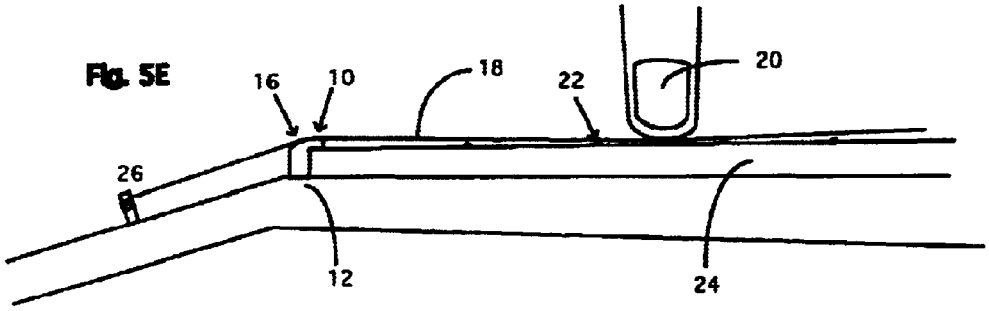
FIG. 5E is an elevation view of the neck of a fretted musical instrument.
Figure 6A:
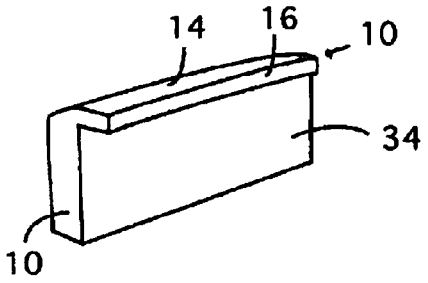
FIG. 6A is an isometric view of an embodiment of the present invention.
Figure 6B:
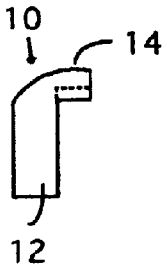
FIG. 6B is a side view of one embodiment of the present invention.
Figure 6C:
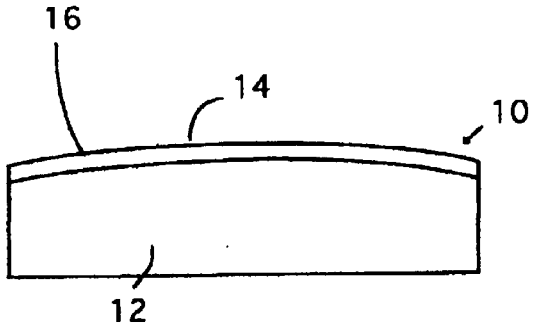
FIG. 6C is a front view of one embodiment of the present invention.
Figure 6D:
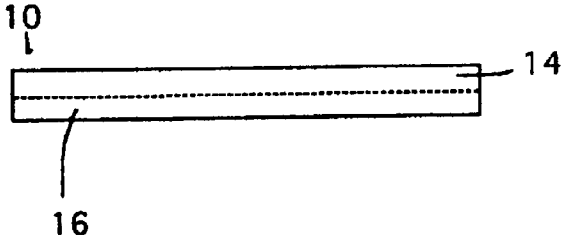
FIG. 6D is a top view of one embodiment of the present invention.
Figure 7A:
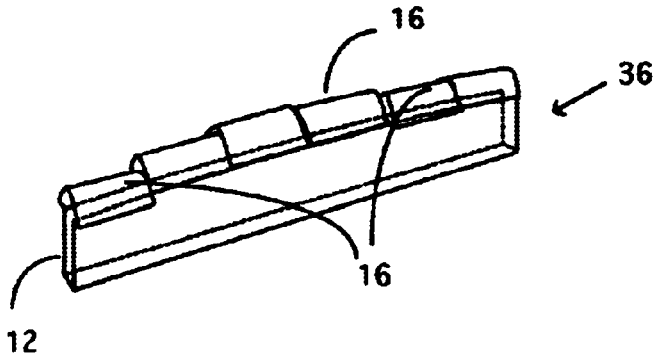
FIG. 7A is an isometric view of an embodiment of the present invention.
Figure 7B:
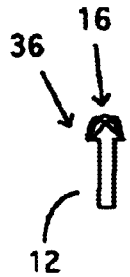
FIG. 7B is a side view of one embodiment of the present invention.
Figure 7C:
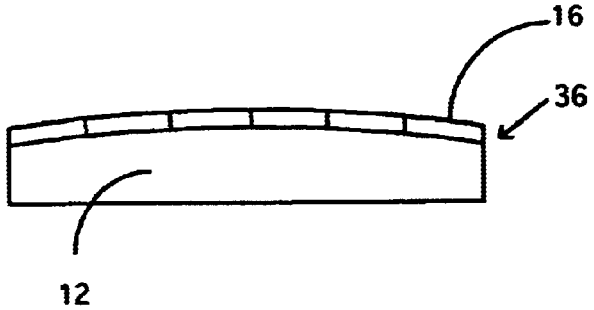
FIG. 7C is a front view of one embodiment of the present invention.
Figure 7D:
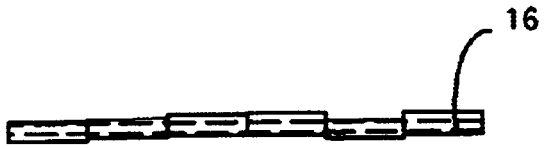
FIG. 7D is a top view of one embodiment of the present invention.
Figure 8A:
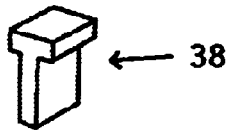
FIG. 8A is an isometric view of an embodiment of the present invention.
Figure 8B:
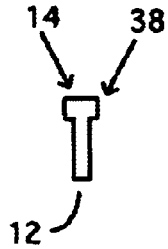
FIG. 8B is a side view of one embodiment of the present invention.
Figure 8C:
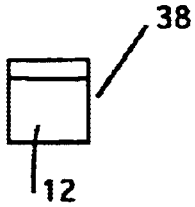
FIG. 8C is a front view of one embodiment of the present invention.
Figure 8D:
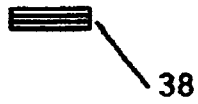
FIG. 8D is a top view of one embodiment of the present invention.
Figure 9A:
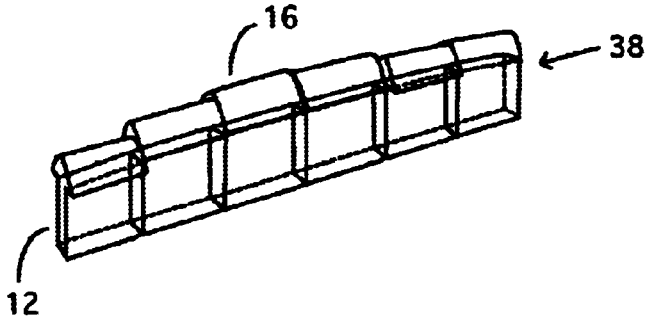
FIG. 9A is an isometric view of an embodiment of the present invention.
Figure 9B:
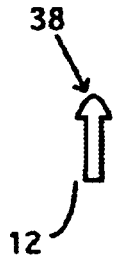
FIG. 9B is a side view of one embodiment of the present invention.
Figure 9C:
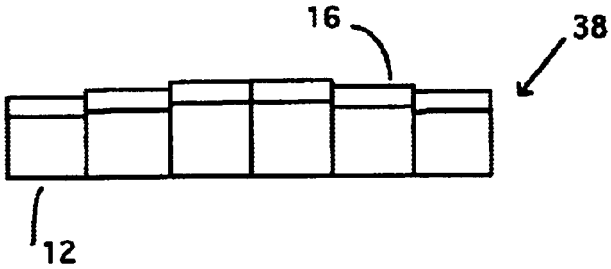
FIG. 9C is a front view of one embodiment of the present invention.
Figure 9D:
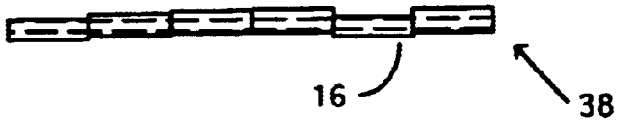
FIG. 9D is a top view of one embodiment of the present invention.
Figure 14A:
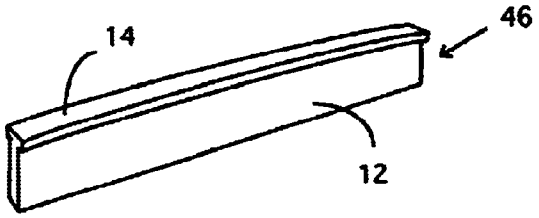
FIG. 14A is a perspective view of one embodiment of the present invention.
Figure 14B:
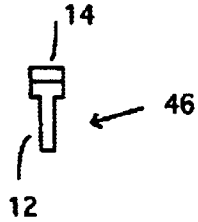
FIG. 14B is a side view of one embodiment of the present invention.
Figure 14C:
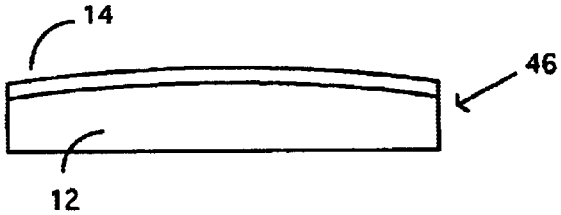
FIG. 14C is a front view of one embodiment of the present invention.
Figure 14D:
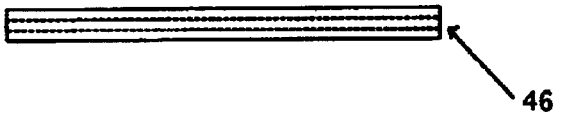
FIG. 14D is a top view of one embodiment of the present invention.

Turning to FIGS. 4A–4E, shown therein is an embodiment of the present invention which would provide a compensated nut 28 by using a plurality of shims 30 to change the vibration point of the nut 28. The embodiment of the present invention shown in FIGS. 4A–4E is intended to provide compensation by the insertion of shims 30 of various lengths in front of an existing nut 28 which, by necessity, would be disposed on top of the fingerboard 24. Also shown in FIG. 4E are the strings 18, fret 22, finger 20 and fingerboard 24.

Turning to FIGS. 5A–5E, shown therein is one embodiment of the present invention being a multiple piece or individual piece embodiment of the compensated nut 10 of the present invention. Shown therein are the nut 10, the pedestal base 12, which pedestal base is normally disposed on the end of fingerboard 24 of a fretted instrument in the conventional manner. Also shown is the crown 14 of the nut 10 showing a configuration of the vibration points 16 which vibration points will extend over the fingerboard 24 of the fretted instrument to compensate for the string 18 stretch. Also shown are frets 22 being depressed by a finger 20 of a player or user of the musical instrument having the present invention mounted thereon. Note that the vibration points 16 are of various sizes or lengths. The embodiment shown in FIGS. 5A–5E comprising nut 10 has an individual piece 32 for each individual string 18 of the fretted instrument. Note that the vibration points 16 extend over the fingerboard 22 to compensate for string stretch.

Turning to FIGS. 6A–6D, shown therein is an embodiment of the present invention being a blank 34 from which blank is formed a compensated nut 10 of the present invention. Shown therein are the nut 10, the pedestal base 12, which pedestal base is normally disposed on the end of the fingerboard of a fretted instrument in the standard manner by one skilled in the art. Note that this embodiment of the present invention provides a blank 34 from which a compensation nut 10 of the present invention could be provided. This embodiment of the present invention 10 would be sold as a blank for customization of the nut by the luthier, repair shop, or end user, to the particular instrument for which compensation is desired.

Turning to FIGS. 7A–7D, shown therein is an embodiment of the present invention being a single unit embodiment of a compensated saddle 36. FIG. 13 shows a typical bridge and an alternative embodiment of a compensated saddle 36. Shown is the pedestal base 12 of the saddle along with vibration points 16. Note that the string vibration points 16 extend beyond the normal boundaries of conventional, existing saddle slots (not shown but see FIG. 13, Item 42). A compensated saddle 36 allows tuning adjustments beyond the limitations imposed by the thickness or width of the pedestal base 12 and the association saddle slot (not shown but see FIG. 13, Item 42) that is disposed in the bridge (not shown but see FIG. 13, Item 40) of the instrument. This is also unique in that it offers expanded compensation without modification to the bridge unit. The saddle 36 can be built of standard materials such as bone, phenolic, micarta, or other composites such as graphite. It is also possible that it can be manufactured from moldable plastic resins such as polyester, molded, milled and fired ceramics. Note that the pedestal base is normally attached into a bridge in the conventional manner. Note that the thickness or width of a saddle slot and an associated pedestal base disposed therein are approximately equal as would be done in the standard manner by one skilled in the art.

Turnings to FIGS. 8A–8D, shown therein are individual non-intonated saddle elements 38 having a pedestal base 12 and a crown portion 14. Shown is a saddle element or blank which has not been machined and in which the user defined vibration point has not yet been created. The elements shown in FIGS. 8A–8D are saddle elements which are intended to be placed side-to-side to form a complete saddle within a tradition saddle slot in the bridge of the fretted instrument. The width of the crown portion 14 of the saddle element 38 allows the vibration point to be modified to make adjustments in the intonation of the fretted instrument.

Turning to FIGS. 9A–9D, shown therein is a completed compensated saddle comprised of individually modified elements 38 as was shown in FIGS. 8A–8D. It should be obvious that the vibration points 16 of the compensated saddle 38 allow tuning adjustments beyond the limitations of traditional saddles without modifications to the bridge. Further, the individual elements 38 optimize sound transmission to under saddle transducers by providing constant string-to-string contact with the transducer. It should be obvious that the vibration points 16 of the compensated saddle 38 allow tuning adjustments beyond the limitations of traditional saddles without modifications to the bridge.

Turning to FIGS. 10A–10C, FIGS. 11A–11C, FIGS. 12A–12C, shown therein are individual saddle elements 38 which can be pre-shaped during manufacture to provide incremental intonation of fretted instruments. The completed saddles 38 comprised of singular elements that are custom selected from a series of pre-shaped elements in order to provide optimum intonation to the particular fretted instrument. It should be obvious that the vibration points of the compensated saddle 38 allow tuning adjustments beyond the limitations of traditional saddles without modifications to the bridge.

Turning to FIG. 13, shown therein is a bridge with a compensated saddle 36 element as described in FIGS. 10A–10C, 11A–11C and 12A–12C installed therein. Shown are the string 18, saddle 36 with pedestal 12 inserted into a groove or saddle slot 42 of the bridge 40 having a bridge pin 44 inserted into the bridge to hold the string 18 in a conventional manner. The string vibration point 16 extends beyond the limit imposed by the thickness of the pedestal base 12 and the corresponding saddle slot 42. Precise measurement often dictates that a properly intonated string should have the bridge vibration point that is beyond the physical limit of a traditional saddle. FIG. 13 clearly indicates a vibration point 16 that is beyond the thickness or width of the saddle slot 42 and which is not available through existing saddle design.

Turning to FIGS. 14A–14D, shown therein is a single unit embodiment of a compensated saddle blank 46 of the present invention. This saddle blank would be machined or manufactured similarly to the nut blank shown in FIGS. 6A–6D. Shown in FIGS. 14A–14D are the pedestal base 12 and the crown 14 which would be manufactured or customized by the luthier, repair shop, or the end user.

I claim:

1. A compensated nut for use on the fretboard of a fretted stringed instrument, comprising:

a) a stringed instrument, said stringed instrument having a fretboard disposed thereon, said fretboard having a first end, a second end and a top surface, said stringed instrument having tuning keys and a bridge disposed thereon, wherein said first end of said fretboard is disposed adjacent to said tuning keys, wherein said fretboard has a slot therein;

b) a compensated nut disposed in said slot on said first end of said fretboard to permit compensation of at least one of the strings of the fretted instrument, said compensated nut having an upper end and a lower end;

c) wherein said compensated nut is disposed on said fretboard between said first and second ends of said fretboard, wherein said compensated nut is disposed adjacent to said first end of said fretboard;

d) a pedestal base disposed on said lower end of said compensated nut, wherein said pedestal base is disposed in said slot in said fretboard;

e) a crown disposed on said upper end of said compensated nut to permit the strings of the fretted instrument to rest thereon, said crown having a top, a first face, and a second face, wherein said first face is disposed toward said first end of said fretboard and said second face is disposed toward said second end of said fretboard;

f) a plurality of string vibration points disposed on said top of said crown of said compensated nut, wherein each of said vibration points has a groove therein for receiving a respective string of the musical instrument; and, g) wherein each of said vibration points extends toward said second end of said fretboard an effective distance to establish the compensated pitch of the string.

2. The compensated nut of claim 1, wherein said compensated nut is disposed on said first end of said fretboard, wherein said compensated nut is disposed contiguous to said first end of said fretboard between said first end of said fretboard and said tuning keys.

3. The compensated nut of claim 2, wherein said compensated nut is disposed substantially perpendicular to said fretboard.

4. The compensated nut of claim 3, wherein said pedestal base is disposed substantially beneath said first face of said crown.

5. The compensated nut of claim 4, wherein said pedestal base is disposed substantially intermediate said first face and said second face of said crown.

6. The compensated nut of claim 5, wherein said pedestal base has substantially the same width as said crown.

7. The compensated nut of claim 6, wherein said pedestal base has a greater width than the width of said crown.

8. The compensated nut of claim 7, wherein each of said vibration points extends over said top surface of said fretboard an effective distance to establish the compensated pitch of the string.

9. The compensated nut of claim 8, wherein each of said vibration points extends beyond the width of said slot within which said slot said pedestal base of said compensated nut is disposed.

10. The compensated nut of claim 9, wherein said vibration points are disposed on at least one shim, said shim being disposed between an existing nut and an existing fretboard.

11. The compensated nut of claim 10, wherein said compensated nut comprises a plurality of elements, said elements disposed adjacent each other, one of each said element corresponding to one of each string of the stringed instrument.

12. A compensated saddle for use on a fretted stringed instrument, comprising:

a) a stringed instrument, said stringed instrument having a fretboard disposed thereon, said fretboard having a first end, a second end and a top surface, said stringed instrument having tuning keys, wherein said first end of said fretboard is disposed adjacent to said tuning keys and said second end of said fretboard is disposed distal to said tuning keys, said stringed instrument comprising a bridge, said bridge having a slot therein;

b) a compensated saddle disposed in said slot on said bridge to permit compensation of at least one of the strings of the fretted instrument, said compensated saddle having an upper end and a lower end;

c) a pedestal base disposed on said lower end of said compensated saddle, wherein said pedestal base is disposed in said slot in said bridge;

d) a crown disposed on said upper end of said compensated saddle to permit the strings of the fretted instrument to rest thereon, said crown having a top, a first face, and a second face, wherein said first face is disposed toward said fretboard and said second face is disposed away from said fretboard;

e) a plurality of string vibration points disposed on said top of said crown of said compensated saddle wherein each of said vibration points has a groove therein for receiving a respective string of the musical instrument; and, f) wherein each of said vibration points extends toward said fretboard an effective distance to establish the compensated pitch of the string.

13. The compensated saddle of claim 12, wherein said compensated saddle is disposed substantially perpendicular to said bridge.

14. The compensated saddle of claim 13, wherein said pedestal base is disposed substantially beneath said first face of said crown.

15. The compensated saddle of claim 14, wherein said pedestal base is disposed substantially intermediate said first face and said second face of said crown.

16. The compensated saddle of claim 15, wherein said pedestal base has substantially the same width as said crown.

17. The compensated saddle of claim 16, wherein each of said vibration points extends beyond the width of said slot within which said slot said pedestal base of said compensated saddle is disposed.

18. The compensated saddle of claim 17, wherein said compensated saddle comprises a plurality of elements, said elements disposed adjacent each other, one of each said element corresponding to one of each string of the stringed instrument.

19. The compensated saddle of claim 18, wherein said pedestal base is disposed substantially beneath said second face of said crown.

20. The compensated saddle of claim 12, wherein each of said vibration points extends away from said fretboard an effective distance to establish the compensated pitch of the string.

* * * * *